US006393043B1

(12) United States Patent
Fuchs

(10) Patent No.: US 6,393,043 B1
(45) Date of Patent: May 21, 2002

(54) TILTABLE ARC FURNACE

(75) Inventor: Gerhard Fuchs, Bodersweier (DE)

(73) Assignee: Arcmet Technologie GmbH, Linz (AT)

( * ) Notice: Subject to any disclaimer, the term of this patent is extended or adjusted under 35 U.S.C. 154(b) by 0 days.

(21) Appl. No.: 09/700,676

(22) PCT Filed: May 21, 1999

(86) PCT No.: PCT/EP99/03523

§ 371 Date: Feb. 8, 2001

§ 102(e) Date: Feb. 8, 2001

(87) PCT Pub. No.: WO99/61857

PCT Pub. Date: Dec. 2, 1999

(30) Foreign Application Priority Data

May 25, 1998 (DE) ..... 198 23 226

(51) Int. Cl.[7] ..... F27D 14/02; F27D 23/00

(52) U.S. Cl. ..... 373/84; 373/78

(58) Field of Search ..... 373/2, 9, 79, 84, 373/72, 78; 266/44, 156, 240, 242, 45, 236

(56) References Cited

U.S. PATENT DOCUMENTS

| | | | | |
|---|---|---|---|---|
| 2,886,617 A | * | 5/1959 | Sorg et al. | 373/84 |
| 4,468,781 A | * | 8/1984 | Buhler | 373/84 |
| 5,054,033 A | * | 10/1991 | Wronka et al. | 373/84 |
| 5,153,894 A | | 10/1992 | Ehle et al. | 373/80 |

FOREIGN PATENT DOCUMENTS

| | | |
|---|---|---|
| DE | 729 569 | 1/1943 |
| DE | 11 08 830 | 2/1957 |
| DE | 33 08 486 | 9/1984 |
| DE | 39 06 653 | 9/1990 |
| DE | 39 07 129 | 9/1990 |
| DE | 44 06 260 | 8/1995 |
| EP | 0 386 586 | 9/1990 |
| FR | 855.303 | 5/1940 |
| WO | WO 93/10413 | 5/1993 |

OTHER PUBLICATIONS

International Search Report completed on Oct. 26, 1999 and mailed on Nov. 3, 1999.

German Search Report.

* cited by examiner

*Primary Examiner*—Tu Ba Hoang
(74) *Attorney, Agent, or Firm*—Foley, Hoag & Eliot LLP

(57) ABSTRACT

In a tiltable arc furnace in which a furnace vessel (2) and a portal (4) for an electrode lifting and pivoting apparatus are arranged on a platform (1 and 3) of a furnace cradle which is tiltable by a tilting apparatus and which includes two mutually spaced cradle runner skids (16) which each run on a respective support path (17), wherein the furnace vessel (2) is arranged on a first platform region which is between the cradle runner skids (16) and the portal (4) is arranged on a second platform region which is outside the cradle runner skids (16) the two platform regions are in the form of separate platform portions (1, 3) which are connected together by a hinge pivot (13), the portal platform portion (3) carrying the portal (4) is supported by way of a further cradle runner skid (20) on a further rolling path (21) and is tiltable by the tilting apparatus synchronously with the vessel platform portion (1) carrying the furnace vessel (2).

9 Claims, 5 Drawing Sheets

TILTABLE ARC FURNACE

TECHNICAL FIELD

The invention concerns a tiltable arc furnace in which a furnace vessel and a portal for an electrode lifting and pivoting apparatus are arranged on a platform of a furnace cradle which is tiltable by means of a tilting apparatus and which includes three mutually spaced parallel cradle runner skids which each run on a respective support path, wherein the furnace vessel is arranged on a first platform portion (vessel platform portion) which is between two cradle runner skids and the portal is arranged on a separate second platform portion (portal platform portion) which is outside said cradle runner skids and which is tiltable by the tilting apparatus synchronously with the vessel platform portion carrying the furnace vessel.

STATE OF THE ART

Of the various designs for arc furnaces, in modern furnaces the variant having a common furnace support stage or furnace platform for furnace vessel and portal has gained extensive acceptance. The furnace platform therefore also carries the portal with the electrode guide columns, the cover lifting mechanism and the associated pivoting and drive mechanisms. The entire furnace is tiltable by means of a tilting apparatus, for example cylinders, by way of a cradle. When that happens, the cradle runner skids are guided on a support path. The furnace usually has two runner skids and thus two support paths which are disposed parallel to the direction of tilting movement on stable foundations. The geometry of the cradle and the support path determines the tilting motion of the furnace vessel. The main support path which is between the vessel and the portal has to carry between about 60% and 700% of the total vertical load, because of the overhanging portal portion.

FR-855 303 A discloses a tiltable arc furnace in which the overhanging part of the platform which carries the portal is supported at the outside by a third cradle sector so that the continuous cradle platform is supported on three parallel cradle sectors. That results in a statistically indefinite application of load.

Special machines are required to machine the bearing seat for the portal for that machining operation can only be effected after the welding procedure, because of the possibility of distortion.

During operation of the furnace distortion can occur because of the different effects of heat acting on the arrangement and stresses within the platform. That for example has an adverse influence on the correctness of the electrode travel paths and the regulation thereof. Correction of the distortion is not possible without expensive and time-consuming dismantling of the vessel, portal and platform.

In the modernization of existing furnaces, it becomes necessary to install a fresh portal for better and faster electrode regulation. Aligning and adapting the platform is then very complicated and expensive.

German published specification (DE-AS) No 11 08 830 discloses a tiltable arc furnace in which the electrode portal is arranged on a cradle which is separate from the furnace cradle and which can either be coupled to the furnace cradle by a first bolt—that is intended for the small tilting movements in the slag tapping operation—or which can be fixed to a stationary mounting by means of a second bolt. The last-mentioned possibility is provided in order to ensure that, when implementing major tilting movements of the furnace vessel, in the tapping operation, the electrodes do not also have to be tilted, which results in electrode fractures. For the tapping operation therefore the electrodes are previously drawn from the vessel and the separate cradle is fixed to the stationary mounting by means of the second bolt.

STATEMENT OF THE INVENTION

In accordance with the invention a tiltable arc furnace of the kind set forth in the opening part of this specification is designed in such a way that the two platform portions are connected together by at least one hinge pivot whose axis of rotation extends parallel to the intersection line between a platform plane and the plane in which a cradle runner skid lies.

The structure according to the invention can be implemented in existing furnaces if for example the portal has to be renewed. The stoppage times can then be substantially reduced. It is also possible without any problem firstly to convert the platform with the portal and then, at a later moment in time, to convert the platform with the furnace vessel. If the configuration according to the invention is embodied in a fresh installation, the subsequent replacement of portal and/or vessel is substantially easier.

An additional tilting apparatus can be mounted to the portal platform, the additional tilting apparatus operating synchronously with the main tilting apparatus.

BRIEF DESCRIPTION OF THE DRAWINGS

The arc furnace according to the invention is described in greater detail hereinafter by means of an embodiment with reference to six Figures in which.

WAYS OF CARRYING OUT THE INVENTION

Figure 1:
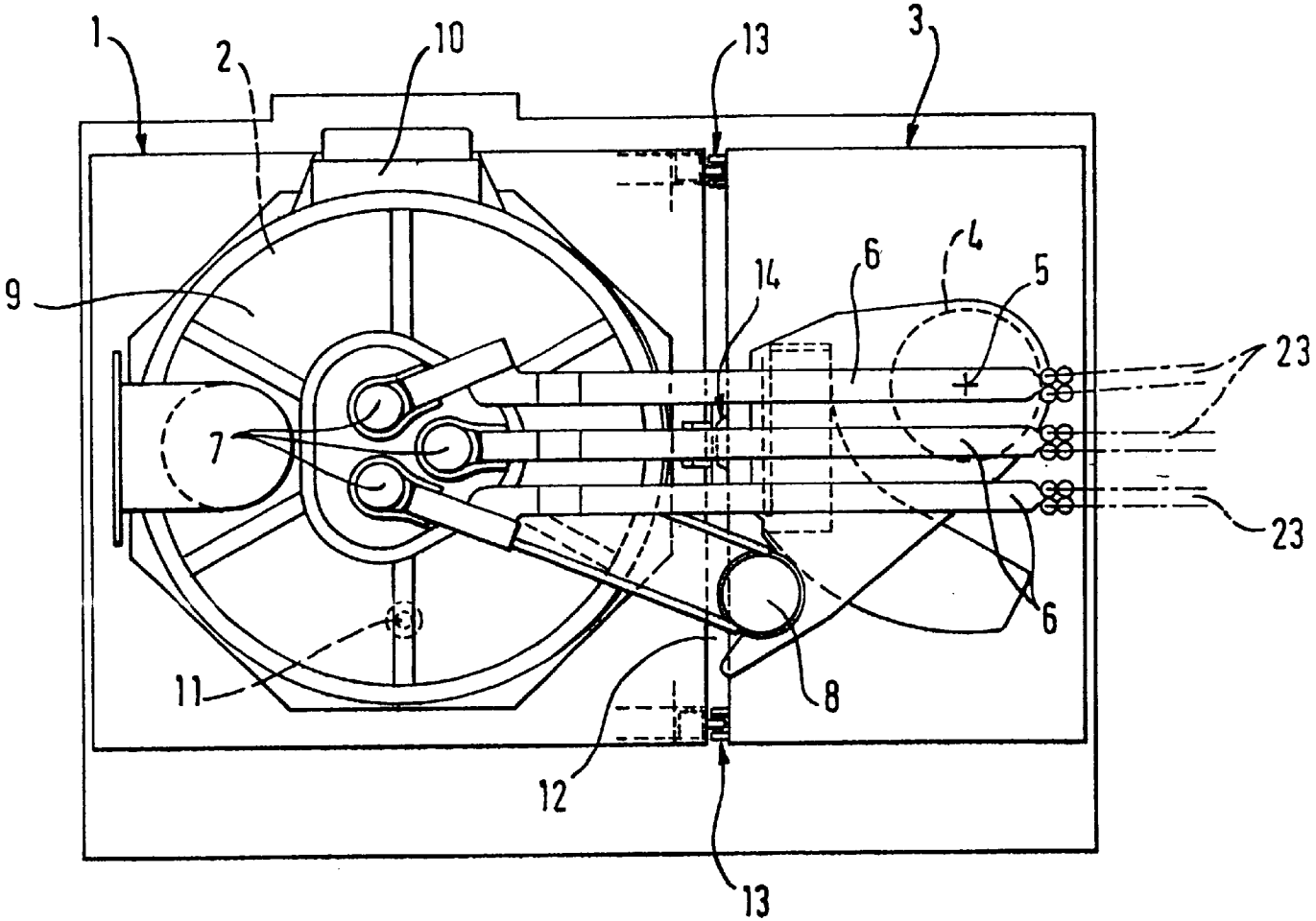
FIG. 1 is a plan view of a tiltable arc furnace.

In the Figures reference numeral 1 denotes the vessel platform portion on which the furnace vessel 2 is arranged, and reference numeral 3 denotes the portal platform portion on which the portal 4 is arranged. The axis of rotation 5 of the portal 4 is arranged in eccentric relationship with the electrode carrier arms 6 which carry the electrodes 7. Reference numeral 8 represents a separate pin for lifting and pivoting out the vessel cover 9. Reference number 10 denotes the working door and reference numeral 11 denotes an eccentric bottom tapping. The platform portions 1 and 3 are separated by a gap 12 and connected by hinge pivots 13. Reference numeral 14 denotes an abutment.

Figure 2:
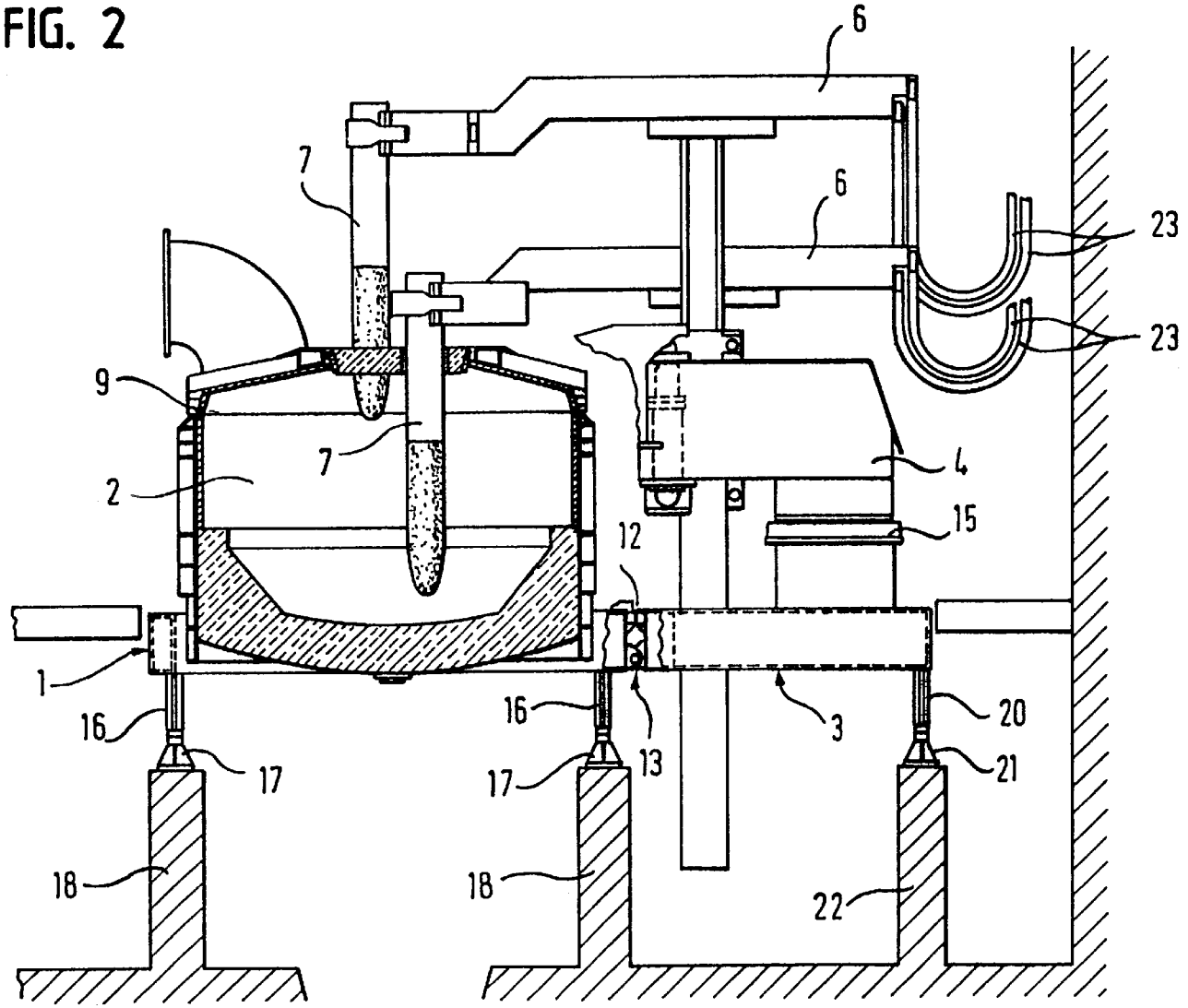
FIG. 2 is a partly sectional front view of the arc furnace.

The front view shown in FIG. 2 additionally reveals the mounting 15 for the portal, as well as the two cradle runner skids 16 with the associated support paths 17 for the vessel platform portion 1 which are fixed on foundations 18. The portal platform portion 3 is supported on one of the cradle runner skids 16 and a further cradle runner skid 20 with a support path 21. The support path 21 is carried on a foundation 22. Reference numeral 23 denotes flexible cables for the supply of power.

Figure 3:
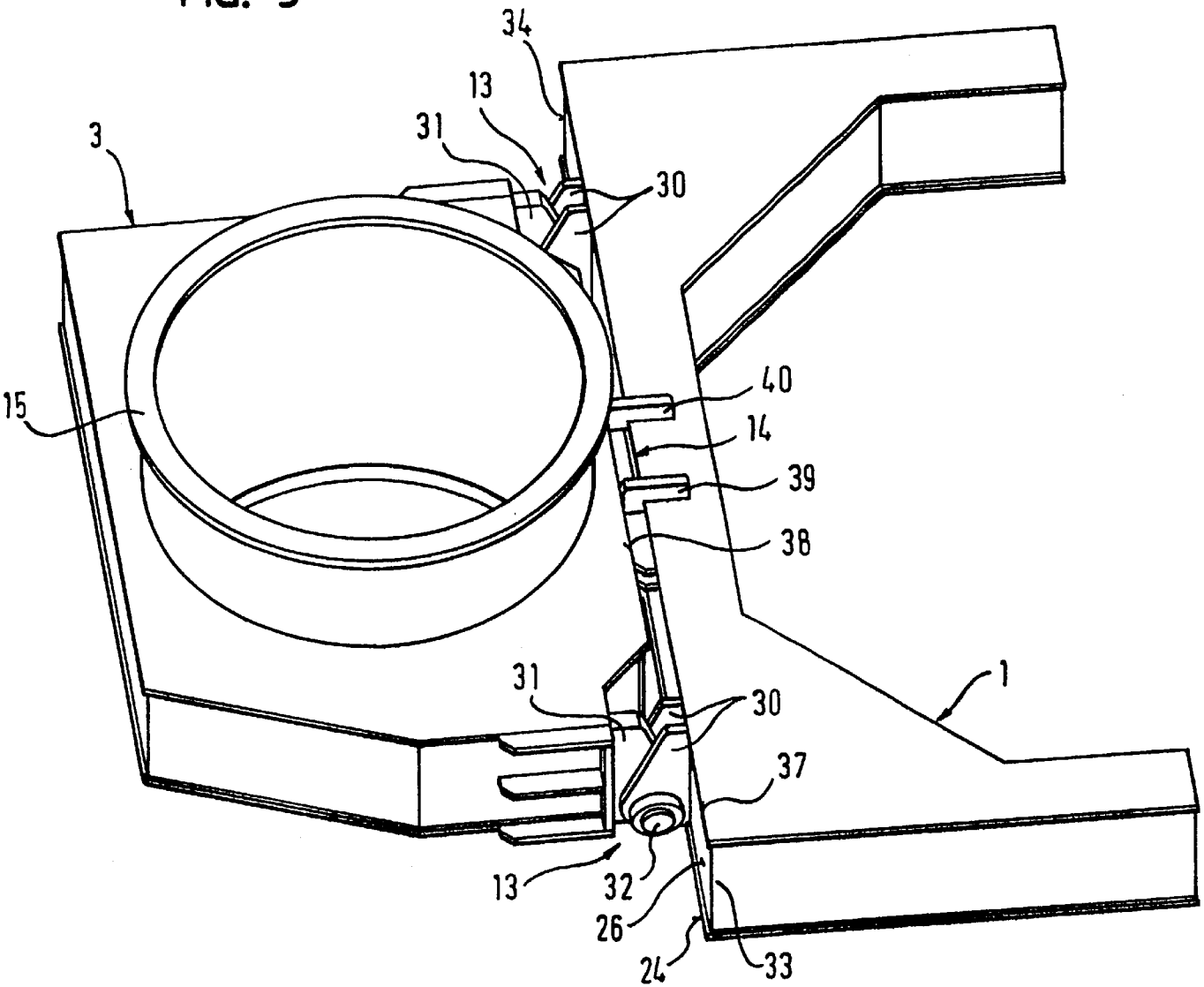
FIG. 3 shows a perspective view of the connection of the platform portions.

The perspective view in FIG. 3 shows the configuration and arrangement of the hinge pivots 13 and the position of the abutment 14.

The axis of rotation 19 of the hinge pivots 13 extends parallel to the intersection line between a platform plane, that is to say for example the plane formed by the top side of the vessel platform 1, and the plane in which a cradle runner skid 16 or 20 is disposed. With linear support paths 17 and 21 therefore the axis of rotation 19 extends parallel to those support paths when the platform is in the horizontal position.

Figure 4:
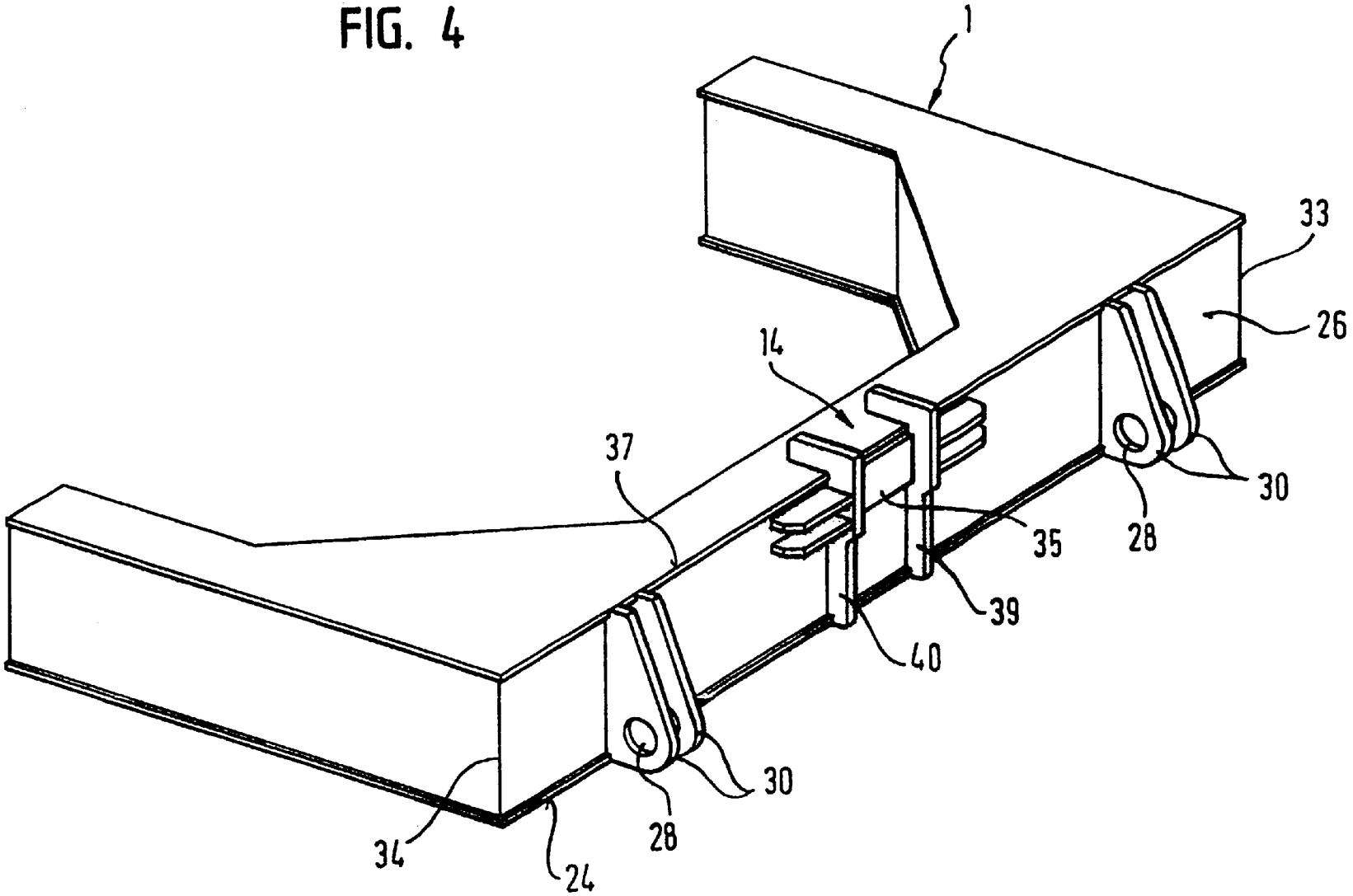
FIG. 4 shows a perspective view of a part of the vessel platform portion.
Figure 5:
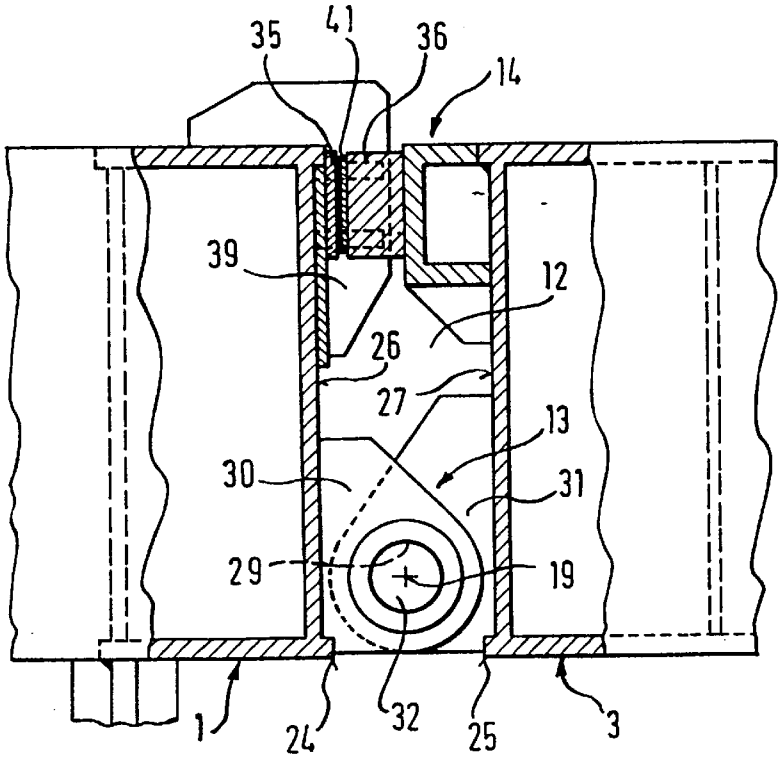
FIG. 5 is a front view of a part on an enlarged scale partly in section showing the connection between the two platform portions by a hinge pivot.

FIGS. 3 through 5 show that the hinge pivots 13 are arranged adjacent to the lower edges 24 and 25 respectively of the mutually facing edge sides 26 and 27 respectively of the platform portions 1 and 3 respectively. The hinge pivots 13 are formed by interengaging plate-shaped projections 30 and 31 respectively which are provided with eyes 28 and 29 respectively and which are mounted to the mutually facing edge sides 26 and 27 respectively of the platform portions 1 and 3 respectively and are rotatably connected together by pivot pins 32.

Figure 6:
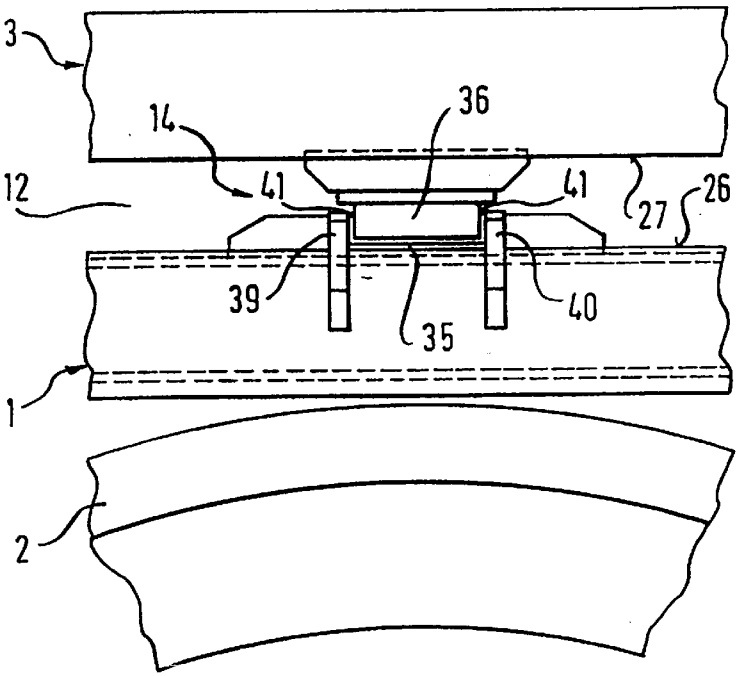
FIG. 6 is a plan view of a part on an enlarged scale of the abutment and the guide between the two platform portions.

In the illustrated embodiment the two hinge pivots 13 are provided in the outer regions of the edge sides 26 and 27, that is to say in the proximity of the sides 33 and 34 of the edge sides, while the abutment 14 is disposed in the central region. As FIGS. 5 and 6 show, the abutment 14 is formed by oppositely disposed abutment portions 35 and 36 whose abutment surfaces are at a spacing of between 1 and 2 mm in operation of the furnace, that is to say when the vessel cover 9 is disposed on the furnace vessel 2. That gap ensures a statistically defined distribution of load to the three foundations by way of the three cradle runner skids 16 and 20. The abutment 14 is provided to restrict the flexural deflection caused when the vessel cover 9 is lifted by virtue of the displacement of the load onto the portal platform portion 3. The abutment 14 is disposed adjacent to the upper edges 37 and 38 respectively of the mutually facing edge sides 26 and 27 of the platform portions 1 and 3 approximately in the central region of the edge sides 26 and 27 respectively.

The entire platform can be tilted by means of a tilting apparatus (not shown in the drawings) which engages the vessel portal portion 1. In that case the pivot pins 32 of the hinge pivots 13 must transmit the forces which are required for also tilting the portal platform portion 3. In that case and also in the tilted condition, forces are operative in the hinge pivot in the axial direction of the pivot pins. The hinge pivots 13 are therefore of such a configuration that the plate-shaped projections 31 engage into plate-shaped projections 30 which are arranged in pairs. It will be appreciated in that case that differences in thermal expansion of the vessel platform portion 1 and the portal platform portion 3 mean that it is necessary to take account of corresponding play in the axial direction of the pivot pins 32. Preferably only one of the two hinge pivots is in the form of a so-called fixed mounting, that is to say a mounting in which displaceability is prevented in the axial direction of the pivot pin 32 while the other hinge pivot is in the form of a sliding mounting in which movement is not restricted in the axial direction of the pivot pin 32.

In the described embodiment the relative position of the two platform portions is fixed in the axial -direction of the pivot pins 32 by side abutments 39 and 40 between which the engagement portion 36 engages. As the guidance action implemented by means of the side abutments 39 and 40 and the abutment portion 36, as between the platform portions 1 and 3, is in the center between the platform portions, different variations in length in the event of different thermal loadings on the two platform portions have a minimum effect here. The guide arrangement can thus be set with a very small clearance of a few tenths of a millimeter. Adjusting plates 41 serve to adjust the clearance and also the spacing between the abutment portions 35 and 36.

The described embodiment has only one tilting apparatus in the region of the vessel platform 1 so that the portal platform 3 also has to be tilted by way of the hinge pivots 13 and the guide arrangement by virtue of the side abutments 39 and 40. It is also possible to provide a further auxiliary tilting apparatus which engages the portal platform portion 3. In that case synchronous actuation of the two tilting apparatuses must be ensured.

What is claimed is:

1. A tiltable arc furnace in which a furnace vessel and a portal for an electrode lifting and pivoting apparatus are arranged on a platform of a furnace cradle which is tiltable by means of a tilting apparatus and which includes three mutually spaced parallel cradle runner skids which each run on a respective support path, wherein the furnace vessel is arranged on a vessel platform portion which is between two cradle runner skids and the portal is arranged on a separate portal platform portion which is outside said cradle runner skids and which is tiltable by the tilting apparatus synchronously with the vessel platform portion carrying the furnace vessel, characterized in that the two platform portions are connected together by at least one hinge pivot whose axis of rotation extends parallel to the intersection line between a platform plane and the plane in which a cradle runner skid lies.

2. An arc furnace as set forth in claim 1 characterized in that besides the electrode lifting and pivoting apparatus the portal platform portion also carries a cover lifting and pivoting apparatus.

3. An arc furnace as set forth in claim 1, characterized in that the platform portions have mutually facing edge sides, lower edges and upper edges, and characterized in that at least one hinge pivot is arranged adjacent to the lower edges of the platform portions.

4. An arc furnace as set forth in claim 3 characterized in that the hinge pivot is formed by mutually interengaging plate-shaped projections which are provided with eyes and which are mounted to the mutually facing edge sides of the platform portions and are connected together rotatably by pivot pins.

5. An arc furnace as set forth in claim 3 characterized in that arranged at the mutually facing edge sides of the platform portions in adjacent relationship to the upper edges is at least one abutment which limits the rotary movement of the hinge pivot and which comprises a respective abutment portion mounted to respective ones of the mutually facing edge sides.

6. An arc furnace as set forth in claim 5 characterized in that the arc furnace has a vessel cover and characterized in that when the vessel cover is resting on the furnace vessel the abutment surfaces of the abutment portions are at a spacing of the order of magnitude of millimeters.

7. An arc furnace as set forth in claim 1 characterized in that a lateral abutment is provided for the purposes of centering the two platform portions in the tilting direction.

8. An arc furnace as set forth in claim 4 characterized in that one hinge pivot is in the form of a fixed mounting which prevents displacement in the direction of the axis of rotation (tilt direction) and one hinge pivot is in the form of a sliding mounting which permits displacement in the direction of the axis of rotation of the pivot pin.

9. A tiltable arc furnace comprising:

a furnace vessel and a vessel platform for supporting said furnace vessel;

a portal and a portal platform for supporting said portal;

a plurality of cradle runner skids arranged in parallel to support said vessel platform and said portal platform wherein said vessel platform is supported by at least two cradle runner skids and said portal platform is supported by at least one cradle runner skid;

a tilting apparatus for independently controlling the positions of said plurality of cradle runner skids supporting said vessel platform and said portal platform such that said platforms may be rotated; and at least one hinge pivot connecting said vessel platform to said portal platform.

* * * * *